US009761997B2

(12) United States Patent
Lux et al.

(10) Patent No.: US 9,761,997 B2
(45) Date of Patent: Sep. 12, 2017

(54) SHIELDING SYSTEM FOR AN ELECTRICAL PLUG CONNECTION

(71) Applicant: Robert Bosch GmbH, Stuttgart (DE)

(72) Inventors: Markus Lux, Winnenden (DE); Martin Saur, Salach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/761,235

(22) PCT Filed: Jan. 2, 2014

(86) PCT No.: PCT/EP2014/050015
§ 371 (c)(1),
(2) Date: Jul. 15, 2015

(87) PCT Pub. No.: WO2014/111271
PCT Pub. Date: Jul. 24, 2014

(65) Prior Publication Data

US 2015/0357766 A1 Dec. 10, 2015

(30) Foreign Application Priority Data

Jan. 18, 2013 (DE) ..... 10 2013 200 810

(51) Int. Cl.
*H01R 13/64* (2006.01)
*H01R 13/631* (2006.01)
*H01R 13/6581* (2011.01)

(52) U.S. Cl.
CPC ..... *H01R 13/6315* (2013.01); *H01R 13/6581* (2013.01); *H01R 2201/26* (2013.01)

(58) Field of Classification Search
CPC H01R 2103/00; H01R 4/646; H01R 13/6315; H01R 13/658; H01R 13/65802; H01R 23/7073
(Continued)

(56) References Cited

U.S. PATENT DOCUMENTS 4,227,765 A 10/1980 Neumann et al.
4,795,352 A * 1/1989 Capp ..... H01R 24/50 439/581
(Continued)

FOREIGN PATENT DOCUMENTS

JP 2003178844 A 6/2003
WO WO 2010/024633 3/2010

OTHER PUBLICATIONS

International Search Report for PCT/EP2014/050015, dated Jan. 2, 2014.

*Primary Examiner* — Thanh Tam Le
(74) *Attorney, Agent, or Firm* — Norton Rose Fulbright US LLP; Gerard Messina

(57) ABSTRACT

An electrical shielding system for an electrical plug connecting includes: a first shielding element; and a second shielding element. The first shielding element and the second shielding element are configured to be plugged into each other, so that the two shielding elements are mechanically and electrically connected. The second shielding element includes a base body and a contacting body which are movable in relation to each other. The electric shielding system further includes a flexible element via which the base body and the contacting body are mechanically coupled to each other.

27 Claims, 2 Drawing Sheets

(58) Field of Classification Search
USPC ..... 439/63, 98, 247, 248, 579, 581, 607.04, 439/607.27, 660
See application file for complete search history.

(56) References Cited

U.S. PATENT DOCUMENTS 5,329,262 A 7/1994 Fisher
5,356,313 A * 10/1994 Niwa ..... H01R 13/65802 439/567
5,431,577 A * 7/1995 Lincoln ..... H01R 13/6315 439/248
5,558,541 A * 9/1996 Botka ..... G01R 1/04 439/248
5,641,294 A 6/1997 Beard
5,842,872 A * 12/1998 Hosler, Sr. ..... H01R 24/50 439/63
5,944,548 A * 8/1999 Saito ..... H01R 13/6315 439/248
6,390,829 B1 * 5/2002 Rademacher ..... H01R 12/7076 174/138 G
6,575,761 B1 * 6/2003 Regnier ..... H01R 9/0515 439/108
7,150,648 B1 * 12/2006 Hall ..... H01R 24/50 439/581
8,465,311 B2 * 6/2013 Takamatsu ..... G02B 6/3821 439/247
8,740,629 B1 * 6/2014 Hall ..... H01R 13/6456 439/63

* cited by examiner

SHIELDING SYSTEM FOR AN ELECTRICAL PLUG CONNECTION

BACKGROUND OF THE INVENTION

1. Field of the Invention

The present invention relates to an electrical shielding system and an electrical plug connection.

2. Description of the Related Art

Plug connections in vehicles must be partially shielded in order to protect other components in the vehicle, such as a control unit or the radio, from electromagnetic radiation. For example, the two plug components (such as the plug and socket) of a shielded plug connection include shielding elements which are plugged into each other when connecting together the plug connection and which accommodate the electrical contacts which are connected in their interior. An electrical connection of the two shielding elements may also be carried out via the contacting point of the two shielding elements.

During the operation of the vehicle, a plug connection may be subjected to considerable vibration exposure. The vibration exposure may cause the shielding elements in a shielded plug connection to move in relation to each other. This may result in wear of the contacting point of the shielding elements and thus to an increased transitional resistance between the two shielding elements. This may result in the premature failure of the shielding and/or the plug connection.

BRIEF SUMMARY OF THE INVENTION

The object of the present invention is to provide a long-lasting shielding for an electrical connection which is subjected to vibration exposure.

One aspect of the present invention relates to an electrical shielding system for an electrical plug connection. The electrical shielding system is designed to shield the interior of an electrical connection, i.e., at least to attenuate electromagnetic radiation which is radiated by the electrical connection, with respect to the surroundings.

According to one specific embodiment of the present invention, the shielding system includes a first shielding element and a second shielding element, the first shielding element and the second shielding element being designed to be plugged into each other, so that the two shielding elements are mechanically and electrically connected. The two shielding elements may include bodies made of an electrically conductive material such as copper, which at least partially surround an electrical connection. The shielding elements may be designed as shielding metal sheets.

For example, the shielding elements may be attached to plug components of the plug connection, and when connecting together the plug connection, may be connected at the same time as electrical contacts of the plug connection. When connecting together, the first shielding element and the second shielding element may be connected to each other via a contacting point, in which the second shielding element is clamped into the first shielding element.

The second shielding element includes a base body and a contacting body which are movable in relation to each other. The base body may be designed to be connected in a mechanically rigid manner to a plug component. The contacting body may carry the contacting point for the first shielding element.

Furthermore, the electrical shielding system includes a flexible element via which the base body and the contacting body are mechanically coupled. At least one of the two shielding elements includes a flexible mechanical connection which is able to absorb shaking movements and vibrations, in order to relieve the contacting point and/or to protect it from relative movements. The flexible element may also be electrically conductive and/or may electrically couple the base body and the contacting body.

In other words, the second shielding element is designed as two parts, the contacting point for the first shielding element being isolated from the base body and being connected to a flexible element. As a result, the contacting point is mechanically decoupled from the rest of the shielding. In this way, relative movements and thus premature wear of the contacting point may be prevented.

According to one specific embodiment of the present invention, the flexible element includes a flexible strip which at least partially surrounds the base body and the contacting body. The flexible element may be a hose or a strip made up of an electrically conductive fabric or mesh work.

According to one specific embodiment of the present invention, the flexible element includes a spring element. The spring element may, for example, include a strip of a metal sheet which is bent in such a way that it has a spring effect. For example, the strip may be S-shaped.

According to one specific embodiment of the present invention, the flexible element includes a line or a cable. The line or the cable may be connected to the base body and the contacting body, for example, via soldering, welding, or riveting.

According to one specific embodiment of the present invention, the flexible element is connected to the contacting body and the base body. The flexible strip, the spring element, and the line may be attached at one end to the contacting body and attached at the other end to the base body. For example, the flexible element may be soldered and/or welded at these points.

According to one specific embodiment of the present invention, a stop is formed between the contacting body and the base body which delimits a movement of the base body in the direction of the contacting body when connecting together the first shielding element and the second shielding element. The stop may, for example, be formed with the aid of an edge of the base body, which may be placed on a shoulder of the contacting body. It is also possible that the stop is formed with the aid of a projection on the contacting body, which may rest on the base body. The end stop may protect the shielding system from the application of excessive pressure during attachment.

According to one specific embodiment of the present invention, the first shielding element includes a tubular section and the contacting body of the second shielding element includes an additional tubular section which may be clamped via the tubular section, so that a mechanical and electrical connection may be established between the first shielding element and the second shielding element. The two shielding elements may have tubular areas or sections which may be plugged into each other and clamped to each other.

According to one specific embodiment of the present invention, the base body of the second shielding element includes a tubular section which is attached to a tubular section of the contacting element and is movable in relation to it. The two parts of the second shielding element may be positioned relative to each other via an overlapping area (i.e., a loose fit). The tubular section of the contacting element may be movable in all directions relative to the base body.

According to one specific embodiment of the present invention, the base body of the second shielding element includes an opening in which a tubular section of the contacting body is accommodated and is movable within it. For example, the base body may provide an opening having a tubular section. It is also possible that the base body includes a flat metal sheet through which the contacting body is guided in such a way that it may be moved in all directions in relation to the flat metal sheet.

Another aspect of the present invention relates to an electrical plug connection for establishing an electrical connection between a first electrical contact and a second electrical contact. For example, the plug connection may be designed to connect a unit, such as an electric drive, of a vehicle to other components of the vehicle, such as a battery.

According to one specific embodiment of the present invention, the electrical plug connection includes a first plug component having the first electrical contact and a second plug component having the second electrical contact, the first plug component and the second plug component being designed to be plugged into each other and to establish the electrical connection between the first electrical contact and the second electrical contact.

According to one specific embodiment of the present invention, the electrical plug connection includes a shielding system as described above and below, in which the first shielding element is attached to the first plug component and the second shielding element is attached to the second plug component, so that when connecting together the plug components, the first shielding element and the second shielding element are plugged into each other and form an electrical shielding for the electrical connection formed from the first electrical contact and the second electrical contact. Such shielded plug connections may be used at attachment points having higher vibration profiles, for example, directly on an electric drive.

According to one specific embodiment of the present invention, the first plug component is attached to an electrical device or unit of a vehicle. The second plug component may be a plug on a cable harness of the vehicle. However, the two-part shielding element or the contacting point may generally be present on the unit side or the plug side.

DETAILED DESCRIPTION OF THE INVENTION

Figure 1:
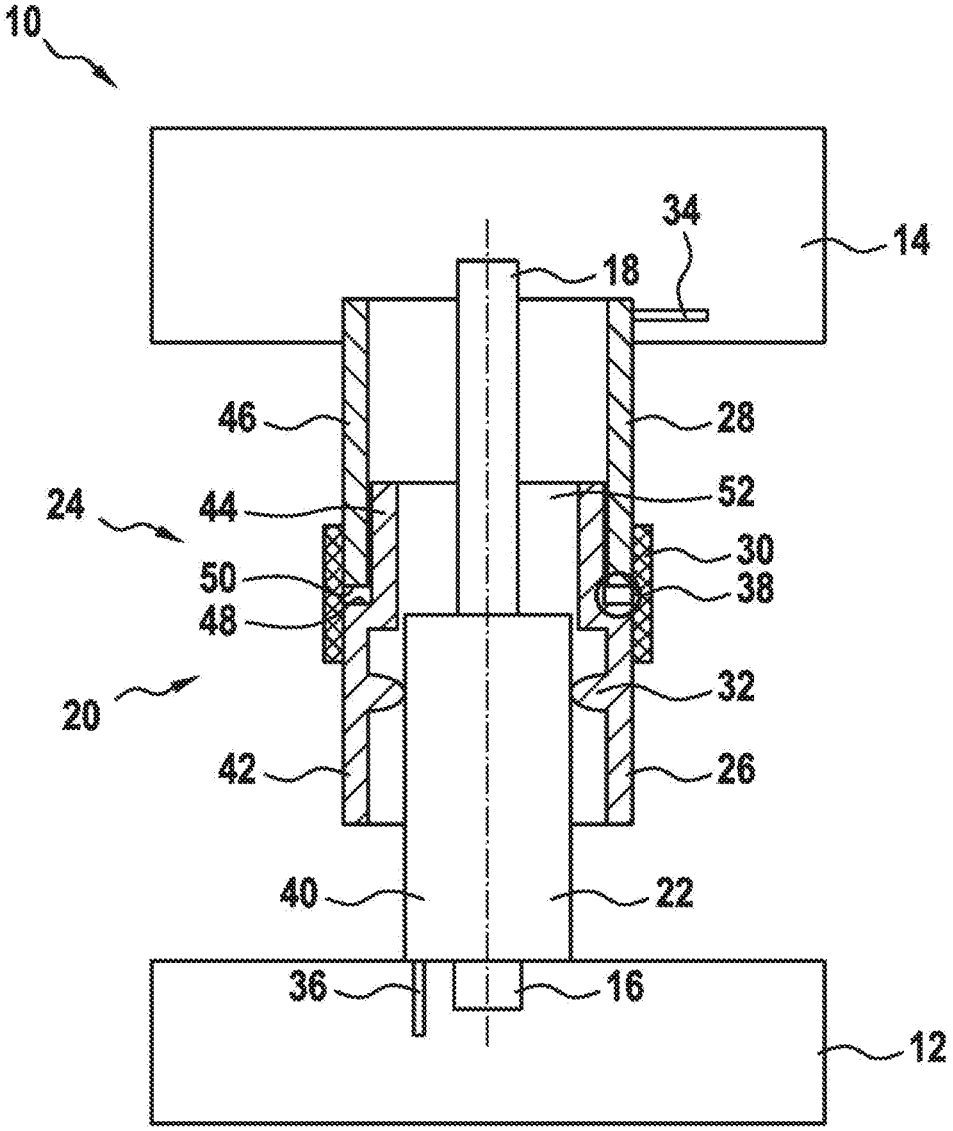
FIG. 1 shows a schematic cross-sectional view of a plug connection according to one specific embodiment of the present invention.

Identical or similar parts are generally provided with the same reference numerals.

FIG. 1 shows a plug connection 10 which includes two plug components 12, 14, each of which includes a contact element 16, 18 in the form of a pin 16 and a corresponding contact 18.

Plug component 12 is, for example, mechanically connected to a control unit or a unit of a vehicle, for example, an electric drive. Plug component 14 is, for example, a cable harness plug 14 which is connected to a cable harness of the vehicle.

The two contact elements 16, 18 are surrounded by a shielding system 20 which includes a first shielding element 22 which is (mechanically rigidly) connected to plug component 12 and which is used as a shield on the control unit side or the unit side.

First shielding element 22 surrounds a contact point between contact elements 16, 18, via which an electrical connection between contact elements 16, 18 is established. For example, electrical signals and/or electric currents, for example, even high-power currents, may be conducted via this electrical connection. For example, the electrical connection may be used to conduct electric currents for the electric drive of a vehicle.

Furthermore, shielding system 20 includes a second shielding element 24 which is configured in two parts and which includes a contacting body 26 and a base body 28 which are mechanically coupled to a flexible element 30. Base body 28 and contacting body 26 may be moved in relation to each other, but are mechanically coupled to each other via flexible element 30.

Second shielding element 24 is used as a cable harness-side shield and is (mechanically rigidly) connected to plug component 14 via base body 28. Contacting body 26 is thus flexibly coupled to plug component 14 via flexible element 30.

Contacting body 26 has a contacting point 32 or a contacting area 32 via which contacting body 26 is mechanically coupled to first shielding element 22. Contacting point 32 may, for example, be a clamp.

The force of contacting point 32 via which contacting body 26 is supported on first shielding element 22 (for example, a clamping force and/or frictional force) is greater than the force which is necessary to deform flexible element 30.

Exactly like contact elements 16, 18, shielding elements 22, 24 and in particular contacting body 26, base body 28, and flexible element 30 are made from an electrically conductive material such as copper.

Shielding elements 22, 24 are connected to each other in an electrically conductive manner (but insulated from contact elements 16, 18) and connected to ground. Base body 28 is electrically connected to a ground conductor 34 of plug component 14; contacting body 26 is electrically connected to base body 28 via flexible element 30; first shielding element 22 is electrically connected to contacting body 26 via contacting point 32; and first shielding element 22 is connected to a ground conductor 36 of plug component 12.

An end stop 38 is present between the base body and the contacting body, which is used to delimit a direction of movement of base body 28 in relation to contacting body 26. In this way, contacting body 26 may be attached to the first shielding element with the aid of base body 28. Applying excessive pressure to the plug connection is also prevented.

As shown in FIG. 1, first shielding element 22 includes a tubular section 40 which surrounds contact element 16.

Contacting body 26 of second shielding element 24 includes a tubular section 42 which surrounds an area of first shielding element 22 and may thus be understood to be a shielding sleeve 42. Tubular section 42 has contacting point 32 on its internal side.

Contacting body 26 has an additional, second tubular section 44, which may have a smaller diameter than first tubular section 42. The two tubular sections 42, 44 are rigidly connected to each other.

Base body 28 has a tubular section 46 which may have the same diameter as first tubular section 42 of contacting body 26. Tubular section 46 of base body 28 is pushed over tubular section 44 of contacting body 26. A small gap is present between the two tubular sections 44, 46 as a loose fit 48.

Generally, contacting body 26 is accommodated in an opening 52 in base body 28 which is provided by tubular section 46.

End stop 38 is formed by an edge 48 of tubular section 42 and by an edge 50 of tubular section 46.

Flexible element 30 may include a hose and/or a strip which is/are connected to base body 28 and contacting body 26. For example, a hose may surround base body 28 and contacting body 26.

Figure 2:
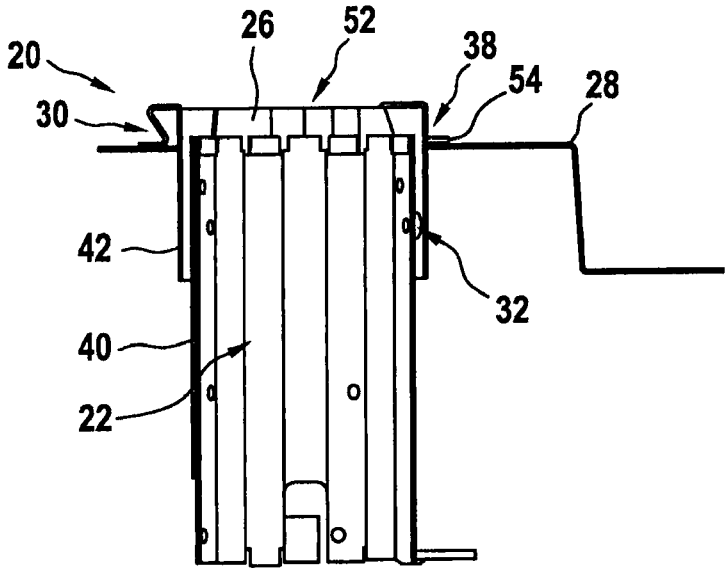
FIG. 2 shows a cross-sectional view of a shielding system according to an additional specific embodiment of the present invention.

FIG. 2 shows an additional specific embodiment of a shielding system 20. In contrast to the specific embodiment shown in FIG. 1, base body 28 of second shielding element 24 is partially designed as a flat metal sheet which runs essentially orthogonally to the extension direction of tubular sections 40, 42 and has an opening 52 in which contacting body 26 is movably accommodated.

Flexible element 30 is designed as a spring element 30 which is formed in such a way that it allows a three-dimensional movement of contacting body 26 in relation to base body 28. The spring element protrudes from an outer side of contacting body 26.

Spring element 30 is, for example, designed as a sheet metal strip bent in an S-shape which may be formed from the sheet metal material of contacting body 26. Spring element 30 is attached to base body 28, for example, with the aid of welding. However, it is also possible that spring element 30 only rests on base body 28.

First shielding element 22 and contacting body 26 have a plurality of contacting points 32 via which contacting body 26 may be clamped via the first shielding element.

A stop 38 is formed by a projection 54 which protrudes from the outer side of contacting body 26. Similarly to spring element 30, stop 38 may be a sheet metal strip which may be formed from the sheet metal material of contacting body 26.

Figure 3:
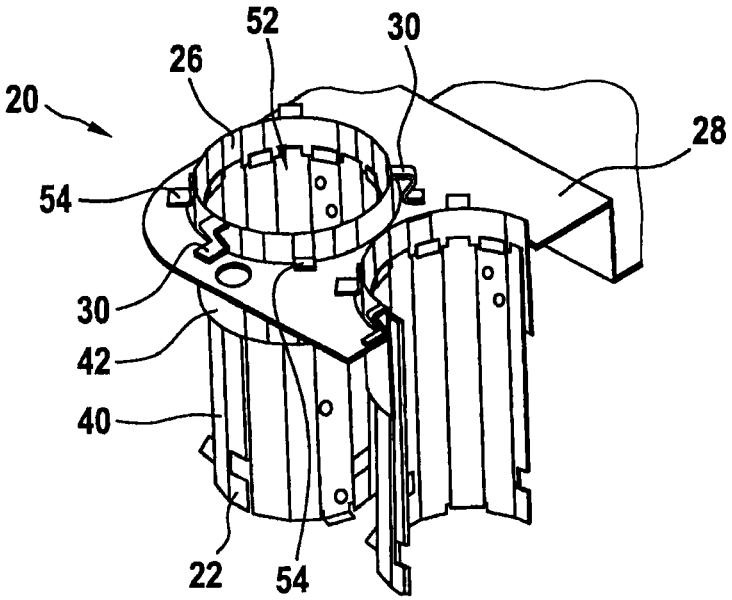
FIG. 3 shows a three-dimensional view of the shielding system from FIG. 2.

As is apparent from FIG. 3, a shielding system 20 may include a plurality of spring elements 30 and/or a plurality of projections 54.

In addition, it should be noted that "including" does not exclude any other elements or steps, and "a" or "an" does not exclude a plurality. It should also be noted that features or steps which have been described with reference to one of the above exemplary embodiments may also be used in combination with other features or steps of other exemplary embodiments described above.

What is claimed is:

1. An electrical shielding system for an electrical plug connection, comprising:

a first shielding element;

a second shielding element, wherein the second shielding element includes a base body and a contacting body, the contacting body being movable relative to the base body after the base body is mechanically rigidly connected to a plug component of the electrical plug connection; and a flexible element, wherein the base body and the contacting body are mechanically coupled to each other via the flexible element;

wherein the contacting body is movable relative to the base body while the contacting body and the base body are mechanically coupled to each other via the flexible element;

wherein the first shielding element and the second shielding element are configured to be plugged into each other, so that the first and second shielding elements are mechanically and electrically connected; and wherein the second shielding element includes a stop allowing some movement of the contacting body relative to the base body, but delimiting further movement of the contacting body relative to the base body, after the first shielding element and the second shielding element are connected together.

2. The electrical shielding system as recited in claim 1, wherein the flexible element includes a flexible strip which at least partially surrounds the base body and the contacting body.

3. The electrical shielding system as recited in claim 2, wherein the flexible element is connected to the contacting body and the base body.

4. The electrical shielding system as recited in claim 2, wherein the flexible strip includes an electrically conductive fabric or mesh work.

5. The electrical shielding system as recited in claim 1, wherein the flexible element includes a spring element.

6. The electrical shielding system as recited in claim 1, wherein the first shielding element includes a tubular section and the contacting body of the second shielding element includes an additional tubular section which is clamped via the tubular section of the first shielding element, so that a mechanical and electrical connection is established between the first shielding element and the second shielding element.

7. The electrical shielding system as recited in claim 1, wherein the contacting body includes a tubular section which is coupled and movable relative to a tubular section of the base body.

8. The electrical shielding system as recited in claim 1, wherein the base body of the second shielding element includes an opening in which a tubular section of the contacting body is accommodated, the tubular section being movable within the opening when the base body is mechanically rigidly connected to the plug component of the electrical plug connection.

9. The electrical shielding system as recited in claim 1, wherein the flexible element allows the movability of the contacting body relative to the base body to be along an axis defining a plugging direction of the electrical plug connection.

10. The electrical shielding system as recited in claim 1, wherein the mechanical coupling of the base body to the contacting body via the flexible element at least partially decouples movement of the contacting body from movement of the base body when the first and second shielding elements are plugged into each other.

11. The electrical shielding system as recited in claim 1, wherein the base body includes a first tubular section and the contacting body includes a second tubular section, the second tubular section having a smaller interior diameter than the first tubular section.

12. The electrical shielding system as recited in claim 11, wherein the second tubular section is configured to at least partially move inside the first tubular section to enable the movability of the contacting body relative to the base body.

13. The electrical shielding system as recited in claim 1, wherein the contacting body includes a first tubular section and a second tubular section, the first tubular section having an internal diameter greater than an internal diameter of the second tubular section.

14. The electrical shielding system as recited in claim 13, wherein the first tubular section includes a contact point for contacting the first shielding element, and the second tubular section is configured to move at least partially within the base body.

15. The electrical shielding system as recited in claim 1, wherein the contacting body includes a contact point for contacting the first shielding element, the contact point including a protrusion from an interior surface of the contacting body.

16. The electrical shielding system as recited in claim 1, wherein the contacting body includes a tubular section and the base body includes a planar portion occupying a plane substantially perpendicular to an extension direction of the tubular section.

17. The electrical shielding system as recited in claim 1, wherein the stop is formed by a first edge of a first tubular section of the base body and a second edge of a second tubular section of the contacting body.

18. The electrical shielding system as recited in claim 1, wherein the base body includes an opening into which the contacting body is movable to provide the movability of the contacting body relative to the base body.

19. The electrical shielding system as recited in claim 1, wherein the contacting body is movable relative to the base body along an axis of the electrical plug connection.

20. An electrical plug connection for establishing an electrical connection between a first electrical contact and a second electrical contact, the electrical plug connection comprising:

a first plug component having the first electrical contact;

a second plug component having the second electrical contact, wherein the first plug component and the second plug component are configured to be plugged into each other and to establish the electrical connection between the first electrical contact and the second electrical contact; and a shielding system including:

a first shielding element attached to the first plug component;

a second shielding element including a base body and a contacting body, the base body being attached to the second plug component, and the contacting body being movable relative to the base body; and a flexible element, wherein the base body and the contacting body are mechanically coupled to each other via the flexible element;

wherein the contacting body is movable relative to the base body while the contacting body and the base body are mechanically coupled to each other via the flexible element:

wherein the first shielding element and the second shielding element are configured to be plugged into each other, so that the first and second shielding elements are mechanically and electrically connected;

wherein when connecting together the first and second plug components, the first shielding element and the second shielding element form an electrical shielding for the electrical connection formed from the first electrical contact and the second electrical contact; and wherein the second shielding element includes a stop allowing some movement of the contacting body relative to the base body, but delimiting further movement of the contacting body relative to the base body, after the first shielding element and the second shielding element are connected together.

21. The electrical plug connection as recited in claim 20, wherein the first plug component is attached to an electrical device of a vehicle and the second plug component is a plug on a cable harness of the vehicle.

22. The electrical plug connection as recited in claim 20, wherein the flexible element includes a flexible material that surrounds the base body and the contacting body.

23. The electrical plug connection as recited in claim 20, wherein the flexible element includes a spring element connected to the contacting body and the base body.

24. The electrical plug connection as recited in claim 20, wherein the base body of the second shielding element includes an opening in which a tubular section of the contacting body is accommodated and movable when the base body is mechanically rigidly connected to the second plug component.

25. The electrical plug connection as recited in claim 20, wherein the contacting body is movable relative to the base body along an axis of the electrical plug connection.

26. A method of shielding an electrical plug connection, the method comprising:

providing a first shielding element mechanically connected to a first plug component;

providing a second shielding element, the second shielding element including a base body and a contacting body, the base body being mechanically connected to the second plug component, the contacting body being movable relative to the base body; and providing a flexible element mechanically coupling the base body and the contacting body, wherein the contacting body is movable relative to the base body while the contacting body and the base body are mechanically coupled to each other via the flexible element;

wherein the first shielding element and the second shielding element are configured to be plugged into each other, so that the first and second shielding elements are mechanically and electrically connected; and wherein the second shielding element includes a stop allowing some movement of the contacting body relative to the base body, but delimiting further movement of the contacting body relative to the base body, after the first shielding element and the second shielding element are connected together.

27. The method as recited in claim 26, wherein the contacting body is movable relative to the base body along an axis of the electrical plug connection.

* * * * *